US005466167A

United States Patent [19]

Scherer

[11] Patent Number: 5,466,167

[45] Date of Patent: Nov. 14, 1995

[54] SELF-TERMINATING PHONE PLUG AND METHOD OF MANUFACTURE

[76] Inventor: John Scherer, 720 Serena Dr., Pacifica, Calif. 94044

[21] Appl. No.: 29,684

[22] Filed: Mar. 11, 1993

Related U.S. Application Data

[62] Division of Ser. No. 856,353, Mar. 23, 1992, Pat. No. 5,238,422.

[51] Int. Cl.[6] ..... H01R 29/00

[52] U.S. Cl. ..... 439/188; 439/578; 29/854; 200/51.1

[58] Field of Search ..... 439/188, 507–513, 439/668, 669, 675, 578–585; 200/51.09, 51.1; 29/854

[56] References Cited

U.S. PATENT DOCUMENTS 4,275,946 6/1981 Manina et al. ..... 439/188
5,076,797 12/1991 Moulton ..... 439/188
5,238,422 8/1993 Scherer ..... 439/188

FOREIGN PATENT DOCUMENTS 1582238 7/1990 U.S.S.R. ..... 439/188

*Primary Examiner*—David L. Pirlot
*Attorney, Agent, or Firm*—H. Michael Brucker

[57] ABSTRACT

A self terminating phone plug having a switch armature disposed between the inner signal carrying shaft and the outer ground shaft wherein the armature is biased to electrically ground the inner shaft except when an actuator carried by the armature and protruding through the outer shaft is urged inward toward the inner shaft, as when the plug is inserted into a jack, in which case the armature disconnects from the outer shaft and ungrounds the inner shaft.

7 Claims, 2 Drawing Sheets

SELF-TERMINATING PHONE PLUG AND METHOD OF MANUFACTURE

This is a divisional of application Ser. No. 07/856,353 filed on Mar. 23, 1992 now U.S. Pat. No. 5,238,422.

BACKGROUND OF THE INVENTION

The present invention is an improvement in an electrical device which, since its introduction many years ago, has become an industry standard while remaining essentially unchanged from its original design. In particular, the invention relates to an electrical connecting device commonly known as a "phone plug" which terminates an electrical cable and permits the cable to be readily connected and disconnected to electrical apparatus. One of the characteristics of the phone plug that has elevated it to a standard piece of equipment for terminating an electrical cable, is the elegant simplicity of its design. The phone plug, which has no moving parts, is sturdy and sure in performing its function permitting it to be connected and disconnected countless times without failure.

In addition to its many other applications, the phone plug has become the standard device by which electrically amplified musical instruments are connected to their amplifiers. And while the phone plug fully performs its function of easily connecting and disconnecting a cable to a musical instrument, it does so with a most undesirable side effect—a high pitched squeal or screech if the amplifier is on at the time, which it frequently is. Although a number of devices have been proposed for eliminating these nerve wracking screeches, no device prior to the present invention has been effective in doing so without at the same time compromising the integrity of the plug as an electrical connecting device. For that reason, phone plugs in use today remain essentially unchanged from their initial design.

The phone plug is characterized by an outer, tubular, cylindrical shaft terminated at one end by a tip member which is connected to a cylindrical shaft which is co-axially aligned within the outer shaft, but electrically insulated therefrom, as is the tip. A cable terminated by a phone plug has its signal carrying conductor electrically connected to the inner shaft member (and thereby the tip), while the outer shaft is connected to the cable ground conductor. When the phone plug is inserted into a mating jack, the tip engages and is held in place by a contactor electrically connected to the instrument's signal generating circuit, while the outer shaft is grounded. These mechanical and electrical features of phone plugs and jacks are well known in the art and have, as mentioned above, become standard, universally used components.

What is also universal, however, is the highly undesirable noise that occurs when a phone plug is connected or disconnected from an instrument while the instrument's amplifier is on. Under those circumstances, it is virtually impossible to either insert or withdraw the phone plug from its jack without the tip, which carries a voltage, from contacting some signal generating element, whether it be part of the jack, the person handling the equipment, or some other nearby object. When the tip makes such contact, the result is a most annoying screeching sound emanating from the speakers being driven by the amplifier to which the cable is connected.

Ever since phone plugs and musical instruments have been used together, the screeching that occurs when the instruments are connected to or disconnected from a "live" amplifier has been a common occurrence, and yet, prior to the present invention, all attempts to solve this problem have been unsatisfactory as either too complicated, too costly or too comprising of the plug as a connector, or some combination thereof. Two such solutions are described in U.S. Pat. Nos. 4,275,946 and 4,275,947. Both of these patents recognize that the solution to the problem is to ground the tip, except when it is engaged in the jack and thereby prevent any cacophonous amplified signal from being delivered to and broadcast from the speakers. The devices taught by these two patents are, however, so complex compared to the simplicity of the phone plug that they compromise the integrity of the phone plug as a reliable means for easily connecting and disconnecting cables to equipment. In both of the aforementioned patents, for example, the outer, tubular shaft of the phone plug which is grounded, and the inner coaxially disposed shaft, which carries a voltage are slidably disposed with respect to one another where, in the standard phone plug, these two elements are not movable at all. These moving members in the aforementioned prior art patents, as well as the springs and other components not found in a standard phone plug render the plug expensive to manufacture and unreliable in operation. For these reasons alone, these prior art devices, as well as others of the same general description, have never enjoyed any commercial success.

The present inventton, by contrast, provides a solution to the problem which is as elegant as the simplicity of the phone plug itself and which in no way compromises the effectiveness of the phone plug as an electrical connecting device.

Accordingly, it is an object of the present invention to provide a means for eliminating the screeching sound that occurs when a phone plug is connected to or disconnected from a musical instrument.

It is another object of the present invention to provide a means for grounding the end of a phone plug at all times other than when it is seated in a phone plug jack.

It is yet another object of the present invention to provide a switch which can be disposed between the outer and inner shahs of a phone plug so as to ground the tip of the plug except when it is seated in a plug jack.

It is another object of the present invention to provide a simple and reliable method of securing a switch between the outer and inner shafts of a phone plug in perfect alignment with a hole in the plug's outer shaft.

Other objects and advantages of the present invention will be made apparent from the summary of the invention and the detailed description of the invention which follows.

SUMMARY OF THE INVENTION

The present invention solves the screeching problem outlined above by grounding the tip of the phone plug except when the plug tip is seated in its jack. The present invention achieves this result by disposing a switch between the phone plug's inner shaft member, which characteristically carries voltage, and the phone plug's outer tubular shaft member, which is commonly grounded. The switch automatically electrically connects the two shafts and thereby grounds the inner shaft, except when the plug tip engages its phone plug jack.

The switch between the two coaxial elements is a simple conducting armature in the form of a narrow strip attached at one end to the inner shah and biased so that its other end is urged against the inner wall of the outer tubular shaft. This armature carries an actuator near the end which is biased against the outer tubular shaft and this actuator protrudes through a hole formed in wall of the outer shaft. The actuator is made of a durable non-conductive material (such as nylon) and has the effect when pushed inwardly toward the interior of the phone plug shah to disconnect the end contact of the armature from the outer shaft member and thereby unground the tip. The hole in the outer tubular member of the phone plug, and thus, the protruding actuator carried by the armature, is located at a distance from the tip which assures that the actuator does not enter the phone plug jack until the tip is in, or nearly in, contact with its jack contact. When the portion of the phone plug outer cylinder through which the actuator protrudes enters the jack, the actuator is depressed toward the center of the phone plug, automatically disconnecting the armature and thereby ungrounding the tip.

Unlike prior art devices, the only modification to the standard phone plug that is required by the present invention is that a small hole be formed at a specified location in the outer tubular shaft. The rest of the invention comprises a single unified member attached to the tip connecting (inner) shaft.

The simplicity, of the present invention is commensurate with the simplicity of the phone plug itself, thus assuring that the reliability of the phone plug to perform its task is in no way compromised by the addition of the present invention and its operation of automatically terminating (grounding) the tip.

The invention also includes a particular design of armature which can be readily secured within the phone plug during its assembly without requiring any significant additional labor to do so, thereby making it possible for the advantages of the present invention to be enjoyed without significantly increasing the cost of the device which it enhances.

The novel features which are characteristic of the invention, both as to its organization and method of operation, together with further objectives and advantages thereof, will be better understood from the following description considered in connection with the accompanying drawings in which presently preferred embodiments of the invention are illustrated by way of examples. It is to be expressly understood, however, that the drawings are for the purpose of illustration and description only, and are not intended as a definition of the limits of the invention.

A DETAILED DESCRIPTION OF THE INVENTION

Figure 1:
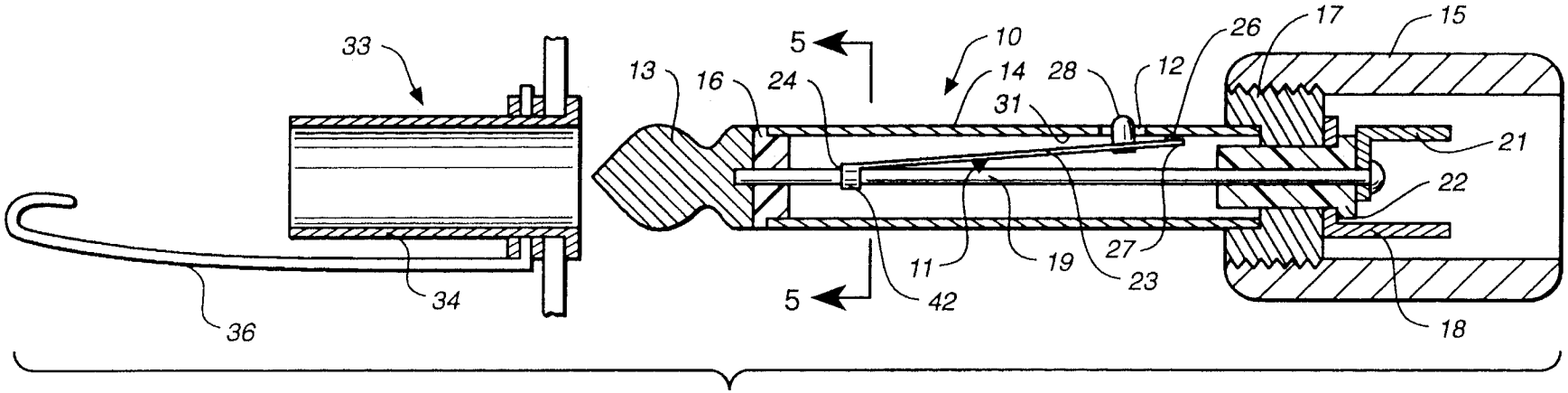
FIG. 1 is a side elevation view of a phone plug and jack including the present invention.
Figure 2:
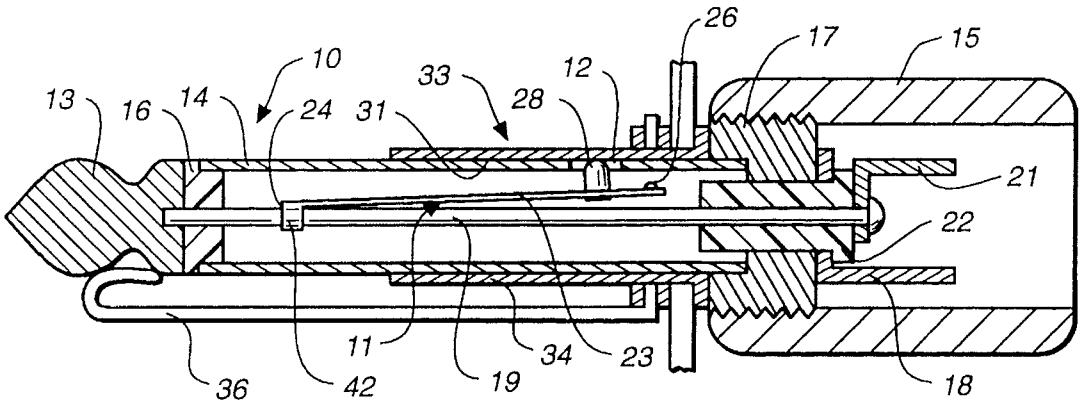
FIG. 2 is a side elevation of the phone plug of FIG. 1 inserted into the jack.

Referring to FIGS. 1 and 2, a phone plug 10 has a cylindrical, tubular outer shaft member 14 which is terminated at one of its ends by a tip 13 and at its other end by an enlarged threaded flange 17 onto which is threaded a handle 15. The tip 13 is insulated from shaft 14 by an annular insulator 16 and connected to a cylindrical inner shaft 19 that is coaxial within the outer shaft 14. The inner shaft 19 extends through (without contacting) flange 17 and is secured at the rear of the flange to an electrical connector 21 which is insulated from flange 17 by an insulator plug 22. A second electrical connector 18 is affixed to flange 17 and thereby electrically connected to outer shaft 14.

Thus, connector 21 is electrically connected to tip 13 through shaft 19 and insulated from outer shaft 14, flange 17, and lead 18. In its well known use, phone plug 10 connects to a cable (not shown) by connecting the cable ground conductor to connector 18 and the cable signal carrying conductor to connector 21. In this way, the tip 13 carries a voltage when the other end of the cable is connected to an operating amplifier, while the shaft member 14 is grounded. It is the presence of the tip 13 carrying a voltage which gives rise to the problems set forth above in terms of screeching and possible damage to amplifiers and speakers. In order to avoid component damage and screeching, the present invention provides a grounding switch 11 between the inner shaft member 19 and the outer tubular shaft member 14.

Figure 3:
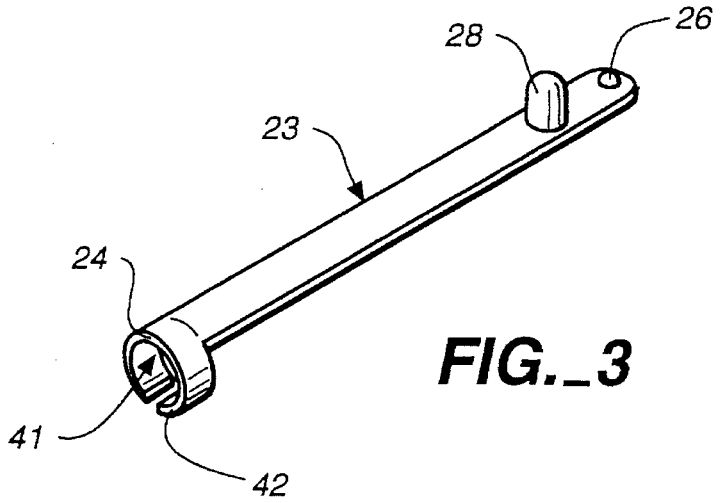
FIG. 3 is a perspective view of the armature of the switch which forms part of the invention.

Referring also to FIGS. 3. 4 and 5, switch 11 comprises an armature 23 electrically and physically secured at its end 24 to inner shaft 19. A contact point 28 is affixed adjacent to the end 27 of armature 23, and an actuator 28 is mounted near the contact point Armature 23 is advantageously formed from a narrow strip of conducting material, such as spring steel, formed to bias the end 27 and thus, the contact point 26, against the inner wall 31 of the cylindrical shaft member 14. The armature spans the space between the shafts, making electrical contact between the inner shaft 19 and the grounded outer shaft 14. The actuator 28 is formed from a durable, non-conductive material, such as nylon or the like, which is located to protrude through a hole 12 in the outer tubular shaft member 14.

When there is no force applied to actuator 28 urging it inwardly toward the center of tubular shaft member 14, the spring bias of the armature 23 causes the contact point 26 to engage the inner wall 31 of outer shaft 14 (the switch 11 is closed) whereby tip 13 is grounded through shaft 19, switch 11 and shaft member 14. In this way, whenever the phone plug is not in use (not plugged in to a jack) the tip 13 is terminated (grounded) and thus, not a potential for generating a noise signal to be fed into the amplifier and broadcast through the speakers.

Referring to FIG. 2, in particular, in operation the plug 10 is inserted into a jack 33 which includes a cylindrical receiving sleeve 34 having an inner diameter just slightly larger than the outer diameter of shaft member 14, and a tip contact and securing member 36. The location of hole 12 in the outer shaft member 14 determines the distance between the actuator 28 and the tip 13. By adjusting that distance a given plug can be either a make-before- break plug or a break-before-make plug. When the distance between the tip 13 and the actuator 28 is such that the actuator is depressed by the jack wall 34 before the tip 13 contacts the securing member 36, the switch 11 will "break" before the tip "makes" connection with the securing member. When on the other hand, the distance between the tip 13 and the actuator 28 is such that the actuator is depressed by the jack wall 34 after the tip 13 contacts the securing member 36, the tip 13 "makes" contact with the jack tip connector 36 before the switch 11 "breaks" ( while the tip is still grounded). Whether a plug is designed to be a make-before-break or a break-before-make depends on the application and the electrical devices involved. The present invention is capable of providing either with only a slight change in the location of the actuator hole 12. No other modification is required.

The armature 23 can be attached to the shah 19 by any conventional means such as a fastener or bonding material. Where, however, the armature is attached to the shaft at a fixed location by bonding or a fastener, it must be precisely located on the shaft at the time of fixation so that the actuator 28 properly aligns with the hole 12 in the outer shaft 14. If that alignment is not perfect, the actuator 28 will not freely pass through the hole 12 and the switch 11 will never close (contact point 26 will not engage outer shaft 14). The present invention provides a means and method for attaching the armature 23 to the shaft 14 in a way that automatically aligns the hole 12 and the actuator 28.

Figure 4:
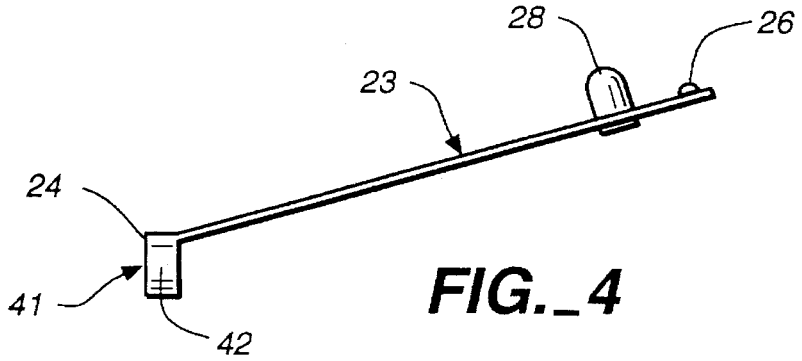
FIG. 4 is a side view of the armature of FIG. 3.
Figure 5:
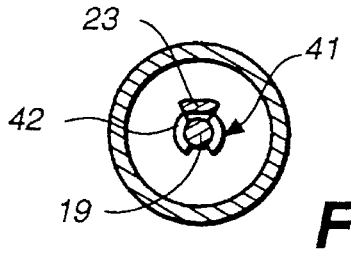
FIG. 5 is a sectional view taken along the line 5—5 of FIG. 1.

Referring also to FIGS. 3, 4 and 5, the armature 23 has formed at its end 24 a split ring securing member 41 having an inner diameter smaller than the diameter of the tip connecting shaft 19. The opposing legs 42 of the split ring securing member 41 can, however, be spread to accommodate and slidably grasp shah 19 and thereby affix the armature 23 to the shaft 19 both mechanically and electrically. The securing member 41 grips the shaft 19 so as to keep the armature in place but at the same time permits the armature 23 to slide along the length of the shaft 19 to the precise location where actuator 28 and hole 12 are aligned. Thus, during assembly of the plug, the tip 13 is joined to its shaft 19 and the annular insulating member 16 located around the shaft 19 and urged up against the tip 13. The split ring connector 42 is placed around the shaft 19 at the general, but not specific location where it will ultimately be located in order to position the actuator 28 within the hole 12. As shaft 14 is passed over shaft 19, the actuator 28 will align with and protrude through hole 12. Preferably that alignment occurs before shaft 14 is fully engaged against the insulator 16. As the outer shaft 14 is thereafter pushed toward abutment with the insulator 16, the actuator will transfer the pushing force from the shaft 14 to the armature 23 which will simply slide along with shaft 19, until shaft 14 abuts the insulator 16. In this way, the armature is self-aligning and does not require any precise location or matching parts during the manufacturing process.

Where the armature 23 is of a unmodified spring metal, it will have a resistance value of essentially zero ohms which is perfectly acceptable for the use described above. There are, however, uses of phone plugs (such as connecting speakers to amplifiers) where the termination (grounding) of the tip could cause damage to the devices connected by the cables to which the plug is joined. To avoid this, the armature 23 can be doped to include a material which will give the armature a resistance value greater than zero, for example 50 ohms or more, so the switch will not create a "dead" short, but will rather terminate the tip through some resistance. While the armature has been described as made of a metal, it can also be formed of a conducting plastic material whether designed to terminate in a dead short or a resistance.

The invention having been fully described, it is understood it is not to be limited to the details herein set forth, but is of the full scope of the appended claims.

I claim:

1. An armature for a switch to be used in combination with an electrical plug having an outer tubular shaft member and a coaxial inner cylindrical shaft member, comprising in combination;

an electrically conductive strip of a length sufficient to span the distance between inner shaft member and the outer shaft member: and a split ring securing member having a pair of opposing arcuate legs integrally connected to one end of said strip wherein the diameter of said split ring securing member is less than the diameter of the inner shaft such that it is necessary to spread apart the arcuate legs to fit around the inner shaft.

2. The invention of claim 1 wherein said armature further includes actuator means attached to said strip at the end of the strip distal from the securing member.

3. An armature for a switch to be used in combination with a tubular shaft member, comprising in combination;

an electrically conductive strip; and an electrically conductive split ring securing member integrally connected to one end of said strip and having a pair of opposing arcuate legs for slidably engaging the shaft.

4. The armature of claim 3 wherein said arcuate legs engage the shaft over sufficient area to make electrical contact between the shaft and said securing member while permiting said securing member to slide along the shaft.

5. A method for aligning the actuator of a switch armature with a hole in the outer tubular shaft of a plug having a coaxial inner shaft member, the steps comprising:

slidably securing the armature onto the inner shaft:

passing the inner shaft into the outer shaft until the actuator registers with and protrudes into the outer shaft hole; and dragging the armature along the inner shaft by relative movement of the outer shaft with reference to the inner shaft until the outer and inner shafts are in place.

6. The method of claim 5 wherein the plug further comprises an outer shaft terminating tip attached to the inner shaft member and an annular insulator between the tip and the outer shaft member, and the further steps of:

slidably securing the armature onto the inner shaft after the shaft and tip have been joined and the annular insulator disposed adjacent the tip; and abutting the outer shaft to the insulator while keeping the actuator and hole in registration by sliding the armature along the inner shaft.

7. The method of claim 6 wherein the armature is further described as having: an electrically conductive strip: and, an electrically conductive split ring securing member integrally connected to one end of said strip and having a pair of opposing arcuate legs for slidably engaging the inner shaft.

* * * * *